US008281896B2

(12) United States Patent
Morgan

(10) Patent No.: US 8,281,896 B2
(45) Date of Patent: Oct. 9, 2012

(54) DRAIN PLUG HOUSING AND DRAIN PLUG APPARATUS FOR USE WITH OIL PANS

(76) Inventor: Raymond Morgan, College Station, TX (US)

( * ) Notice: Subject to any disclaimer, the term of this patent is extended or adjusted under 35 U.S.C. 154(b) by 898 days.

(21) Appl. No.: 12/286,349

(22) Filed: Sep. 30, 2008

(65) Prior Publication Data

US 2009/0101440 A1 Apr. 23, 2009

Related U.S. Application Data

(60) Provisional application No. 60/999,381, filed on Oct. 18, 2007.

(51) Int. Cl.
*F01M 11/04* (2006.01)

(52) U.S. Cl. ..... 184/1.5

(58) Field of Classification Search ..... 184/1.5, 184/75, 82, 84, 105.3, 106; 123/196 R; 137/539, 137/149.6, 184, 351, 100; 251/265, 215–217; 292/1

See application file for complete search history.

(56) References Cited

U.S. PATENT DOCUMENTS

| | | | | | |
|---|---|---|---|---|---|
| 462,478 | A | * | 11/1891 | Errington | 251/217 |
| 477,192 | A | * | 6/1892 | Bastian | 251/265 |
| 612,914 | A | * | 10/1898 | Schmidt | 251/217 |
| 1,642,412 | A | * | 9/1927 | Farnsworth | 251/265 |
| 1,835,020 | A | * | 12/1931 | De Forest | 251/211 |
| 2,474,430 | A | * | 6/1949 | Laue | 251/217 |
| 4,294,333 | A | * | 10/1981 | Little | 184/106 |
| 4,695,088 | A | * | 9/1987 | Jensen | 296/38 |
| 4,905,643 | A | * | 3/1990 | DeGrazia, Jr. | 123/196 S |

* cited by examiner

*Primary Examiner* — Michael Mansen
*Assistant Examiner* — Robert T Reese

(57) ABSTRACT

A drain plug housing body coupled to the interior of an oil pan, which receives, via threaded portions, an extended length drain plug. The drain plug housing further comprises a first threaded aperture having a first diameter terminating at the interior of the oil pan and a second threaded aperture having a second diameter greater than the first diameter, with a hollow cavity therein between. The drain plug is a substantially cylindrical bolt of varying diameters having a first male threaded portion and a second male threaded portion on its shaft that are compatible, respectively, with each of the threaded apertures of the drain plug housing.

15 Claims, 10 Drawing Sheets

DRAIN PLUG HOUSING AND DRAIN PLUG APPARATUS FOR USE WITH OIL PANS

CROSS REFERENCE TO RELATED APPLICATION

This application claims the benefit of U.S. Provisional Application No. 60/999,381 filed on Oct. 18, 2007, entitled "IMPROVED DRAIN PLUG HOUSING AND DRAIN PLUG APPARATUS FOR USE WITH OIL PANS".

FIELD OF THE INVENTION

The present invention relates to engines, and more particularly, oil pan housings and drain plugs.

BACKGROUND

Motor oil is a lubricant in internal combustion engines, typically found in automobiles and other vehicles, boats, lawn mowers, trains, airplanes. In engines there are parts which move very closely against each other at high speeds, often for prolonged periods of time. Such motion causes friction, absorbing otherwise useful power produced by the engine and converting the energy to heat. Friction also wears away the contacting surfaces of those parts, which could lead to lower efficiency and degradation of the engine. This increases fuel consumption.

Lubricating oil makes a film between surfaces of parts moving next to each other so as to minimize direct contact between them decreasing friction, wear, and production of excessive heat, thus protecting the engine. Motor oil also carries away heat from moving parts, which is important because materials tend to become softer and less abrasion-resistant at high temperatures.

However, over time, engine oil breaks down and/or becomes contaminated. Hence, engine manufacturer warranties often require periodic changing of oil. When the engine is not in operation, oil collects in an oil pan. Oil pans are detachable mechanisms made out of thin steel and bolted to the bottom of the crankcase. To maximize its function, it is molded into a deeper section and mounted at the bottom of the crankcase to serve as an oil reservoir. On the bottom of the oil pan is the oil drain plug. When an engine is at rest, the oil pan gathers the oil as it flows down from the sides of the crankcase.

In the conventional oil pan with a drain plug, the drain plug can be removed to allow old oil to seep out of the oil pan during an oil exchange. The drain plug is then screwed back into the drain hole after the used oil is drained out. Drain plugs are usually constructed with a magnet in it, which in turn collects metal fragments from the oil. Other varieties contain a replaceable washer to prevent leakage caused by corrosion or worn threads in the drain hole. The existing drain plug is typically a short bolt (approx. 0.75 inch) that is configured in a vertical position—that is the bolt is threaded into the flat bottom plane of the oil pan, wherein the plane of the oil pan is parallel with the ground. There is a hole drilled into the bottom of the oil pan and the drain plug seal threads are part of the thin wall of the oil pan container.

However, unscrewing conventional drain plugs with a wrench results in oil escaping from the oil pan around the threads of the drain plug prior to the drain plug being entirely removed. This oil often ends up on the hands of the mechanic or person removing the oil drain plug and possibly, on the ground. What is desired is an improved oil pan that has a drain plug housing and drain plug received therein that overcomes the disadvantages associated with conventional oil pans and drain plugs.

SUMMARY OF THE INVENTION

The present invention relates to improvements in oil pans. The present invention comprises a substantially cylindrical drain plug of varying diameters with two threaded male portions on its elongate shaft and a drain plug housing having threaded female apertures adapted to rotatably receive the threaded drain plug. The present invention is operable to facilitate the convenient and quick draining of used motor oil from the oil pan of an internal combustion engine. The present invention is a significant improvement over conventional oil pans and related drain plugs. The present invention can be incorporated into existing oil pans as the oil pan drain housing design is constructed to be coupled to the inside of an oil pan.

The present invention, having two components, the drain plug housing and the drain plug, is constructed of metal or metal alloy and carbon steel or steel alloy materials respectively. It comprises, in one embodiment, a drain plug housing coupled to an oil pan, which receives, via threads, an extended length drain plug. The drain plug housing further comprises a first threaded aperture having a first diameter terminating at the interior of the oil pan and a second threaded aperture having a second diameter greater than the first diameter, with a hollow cavity therein between. The drain plug is a bolt having an elongated shaft that has a first male threaded portion and a second male threaded portion on its shaft that are compatible, respectively, with each of the threaded apertures of the drain plug housing. The drain plug is adapted to enter the rear of the drain plug housing from a horizontal position. When the first male threaded portion of the drain plug is screwed all the way through the first threaded aperture (necessarily requiring the second male threaded portion of the drain plug to be threaded through the second threaded aperture of the drain plug housings), then an oil seal ring washer is seated against the front part of the drain plug housing and oil is retained within the oil pan.

The present invention allows persons who would not ordinarily change their motor oil a convenient way to do so thus making it easier to comply with manufacturer's engine warranties. Specifically, a person is able to avoid hand contact with the engine oil when draining it due to the extended length design of the bolt type drain plug. Further, the present invention facilitates compliance with environmental rules as an embodiment of the present invention uses a secondary plug at the bottom of the hollow cavity within the drain plug housing as a margin of safety to prevent the oil from leaking from the pan to the ground. Oil is diverted from the oil pan, through a first threaded aperture, into the hollow cavity and then out of the housing through an oil drain outlet.

To those skilled in the art to which this invention relates, many changes in construction and widely differing embodiments and applications of the invention will suggest themselves without departing from the scope of the invention as defined herein and the appended claims. The disclosures and the descriptions herein are purely illustrative and are not intended to be in any sense limiting.

DESCRIPTION OF THE DRAWINGS

A more complete understanding of the present invention may be obtained by reference to the following Detailed Description, when taken in conjunction with the accompanying Drawings, wherein.

DETAILED DESCRIPTION

The present invention will now be described more fully with reference to the accompanying drawings, in which preferred embodiments of the present invention are shown. The present invention may, however, be embodied in many different forms and should not be constructed as limited to the embodiments set forth herein; rather, these embodiments are provided so that this disclosure will be thorough and complete, and will fully convey the scope of the present invention to those skilled in the art.

The present invention, having two components, the drain housing and the drain plug, is constructed of metal and metal alloy materials. It comprises, in one embodiment, a housing body coupled to the interior of an oil pan, which receives, via threads, an extended length drain plug. The drain plug housing further comprises a first threaded aperture having a first diameter terminating at the interior of the oil pan and a second threaded aperture having a second diameter greater than the first diameter, with a hollow cavity therein between. The drain plug is a bolt that has a first male thread and a second male thread that are compatible, respectively, with each of the threaded apertures of the drain plug housing. The drain plug is adapted to enter the rear of the drain plug housing from a horizontal position. When the first male threaded portion of the drain plug is screwed all the way through the first threaded aperture (necessarily requiring the second male threaded portion of the drain plug to be threaded through the second threaded aperture of the drain plug housings), then an oil seal ring washer is seated against the front part of the drain plug housing and oil is retained within the oil pan.

More specifically, the present invention comprises a drain plug and a drain plug housing adapted to receive, via two threaded apertures, the extended length bolt type drain plug having two threaded portions on its shaft. The multiple thread design is adapted to sturdy the shaft of the drain plug and guide a seal proximate the first threaded portion of the drain plug against a face of the drain plug housing. The drain plug housing is adapted to be coupled to the interior of an oil pan or can be made integral therewith. The components of the present invention are constructed of, inter alia, a hard steel material customary in the engine construction industry.

Figure 1A:
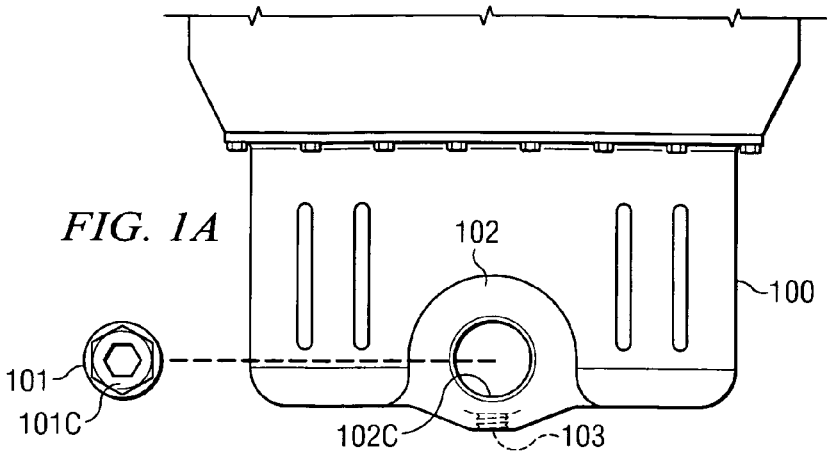
FIG. 1A is a rear view of an oil pan having the drain plug housing and drain plug of the present invention.

Referring now to FIG. 1A, a rear view of the oil pan 100 and a rear view of drain plug 101 of the present invention is provided. As seen in this view, drain plug 101 is adapted to receive an Allen wrench at the distal end thereof for tightening and removing drain plug 101. Drain plug 101 is coaxially received in drain plug housing aperture 102C of drain plug housing 102. Oil drain outlet 103 is an aperture perpendicular to, and below, the coaxial drain plug aperture 102A.

Figure 1B:
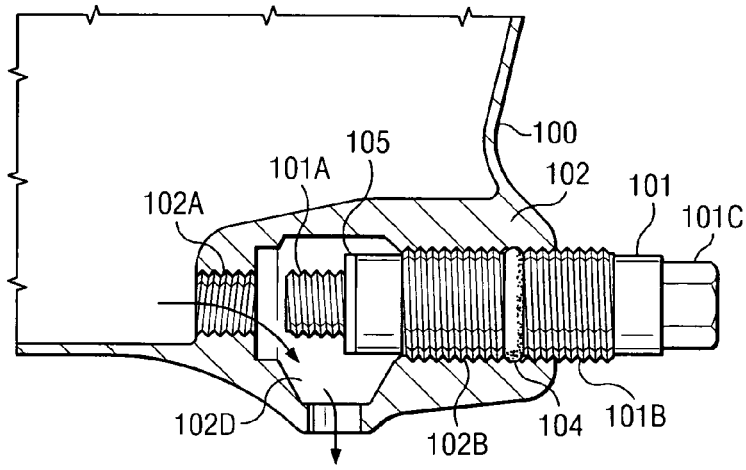
FIG. 1B is a cross sectional side view of the drain plug housing and the drain plug of the present invention in the open position.
Figure 1C:
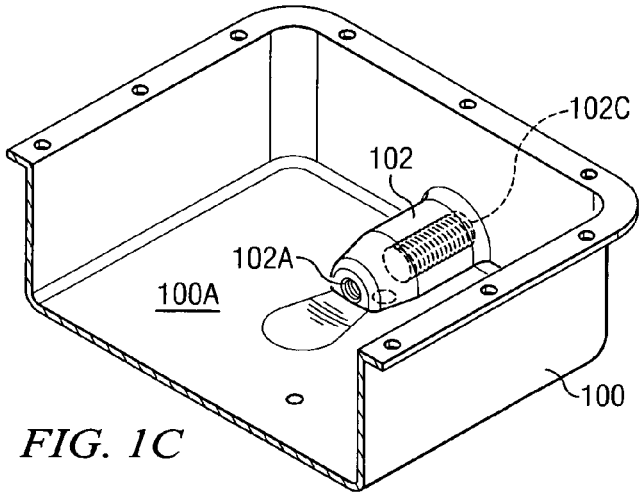
FIG. 1C is a perspective view of the inside of an oil pan showing the drain plug housing of the present invention.

FIG. 1B is a cross section of the drain plug housing 102 with drain plug 101 in the open position. The drain plug 101 of the present invention has a first threaded portion 101A and a second threaded portion 101B as seen in FIG. 1B. The drain plug housing 102 has a first threaded aperture 102A with a first diameter, which is proximate the oil pan cavity 100A, and a second threaded aperture 102B having a diameter greater than the first diameter. A drain plug housing cavity 102D is formed between the first threaded aperture 102A and second threaded aperture 102B. The first threaded portion 101A of the drain plug 101 is adapted to be inserted through the second threaded aperture 102B, its diameter being less than the diameter of the second threaded aperture 102B, so it is received without engaging the threads of the second threaded aperture. As the second threaded portion 101B of the drain plug 101 is threaded through the second threaded aperture 102B, the first threaded portion 101A advances until it is received at the first threaded aperture 102A. At the point it is received at the beginning of the first threaded aperture 102A, the second threaded portion 101B of the drain plug 101 has already been received at the second threaded aperture 102B and advanced a portion of the way therethrough. Careful machining and matching of these components is necessary to ensure that the threads of the drain plug 101 and the threaded apertures of the drain housing 102 engage when the drain plug 101 is rotated. The wrench flats 101C at the distal end of drain plug 101 are smaller than the second threaded portion 102B so as not to restrict the oil seal plug functionality of the first threaded portion 101A against an interior face of drain plug housing 102. Optional first oil seal ring washer 104 threaded on the second threaded portion 101B and is adapted to seal the second threaded aperture 102B. Oil seal ring washer 105 is seated on a 90 degree angled face formed at the end of the first threaded portion of the drain plug. and is adapted to be tightened against an interior face of drain plug housing 102 so as to prevent oil leaks from the oil pan cavity 100A.

Figure 2A:
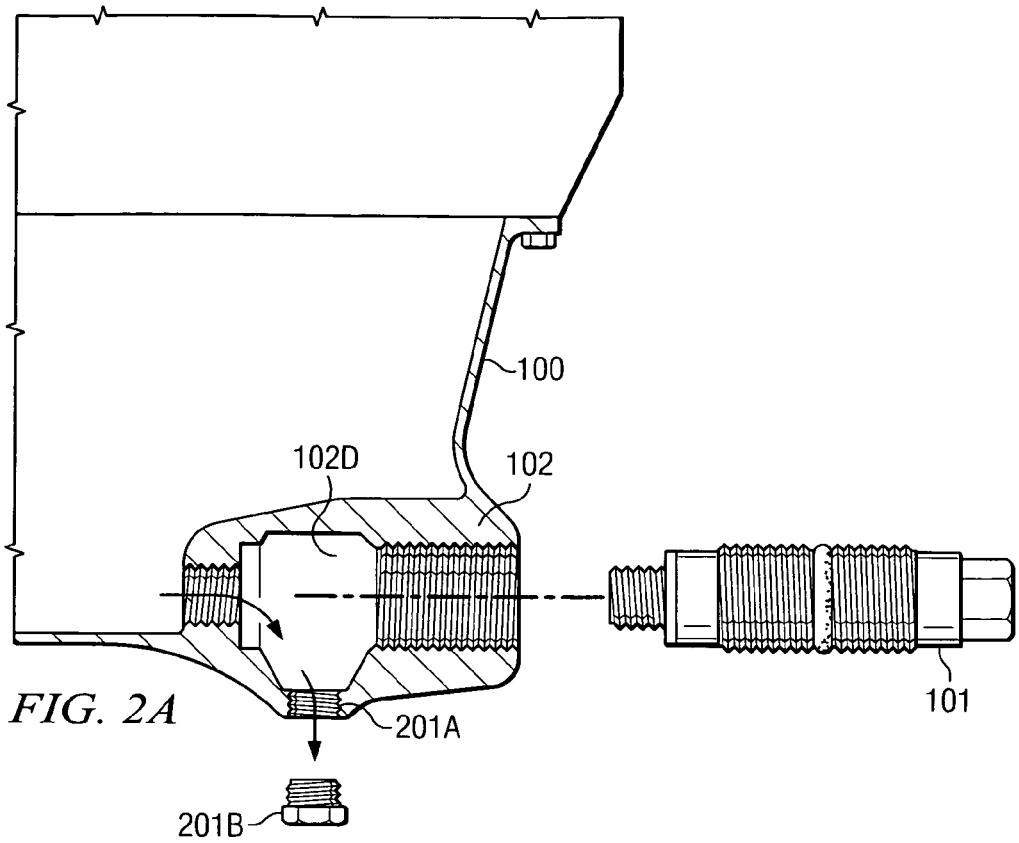
FIG. 2A is cross sectional side view of a portion of an oil pan showing the drain plug housing and drain plug of the present invention.
Figure 2B:
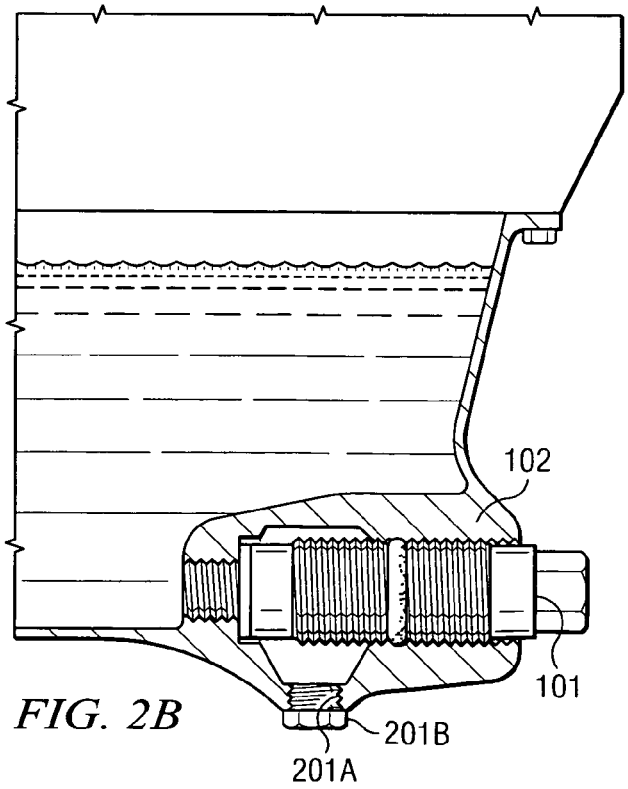
FIG. 2B is a cross sectional side view of an oil pan with the drain plug of the present invention showing the drain plug being threaded into the threads of the drain plug housing of the present invention.

Referring now to FIG. 2A, a further embodiment of the present invention is provided wherein drain outlet 103 comprises a third threaded aperture 201 A and a secondary oil plug cap 201B. FIG. 2A illustrates the further embodiment with the drain plug 101 removed from the drain plug housing 102 and the secondary oil plug cap 201B removed from the third threaded aperture 201A and FIG. 2B illustrates the further embodiment of the present invention wherein the drain plug 101 is fully engaged and sealing the apertures of the drain plug housing 101 with the secondary oil plug cap 201B fully engaged and sealing the third threaded aperture 201A.

Figure 3:
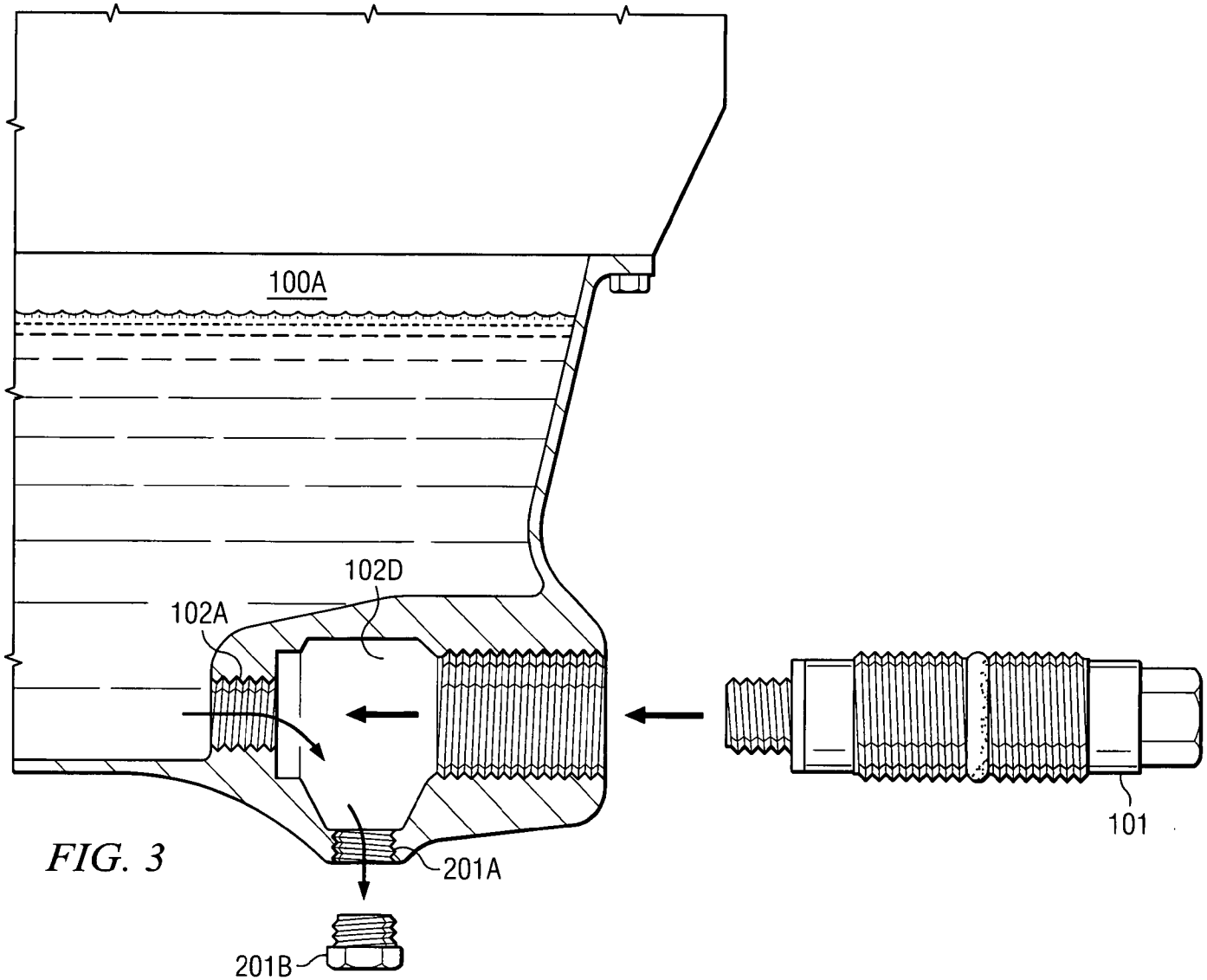
FIG. 3 is a magnified view of the drain plug housing of the present invention receiving the drain plug of the present invention.

FIG. 3 is a magnified view of the further embodiment of the present invention wherein it is seen that the drain plug housing 102 is designed and constructed as part of a cover like oil shed. The drain plug housing 102 includes hollow cavity 102D through which the drain plug 101 can traverse. When the drain plug 101 is backed/unscrewed only a few turns, it allows the used oil (seen in oil pan cavity 100A) to escape out of the first threaded aperture 102A, into the drain plug housing cavity 102D and out the oil drain outlet. In any embodiment to the present invention, the oil pan preferably has a substantially inclined bottom so that oil collects near the first threaded aperture of the drain plug housing.

Figure 4:
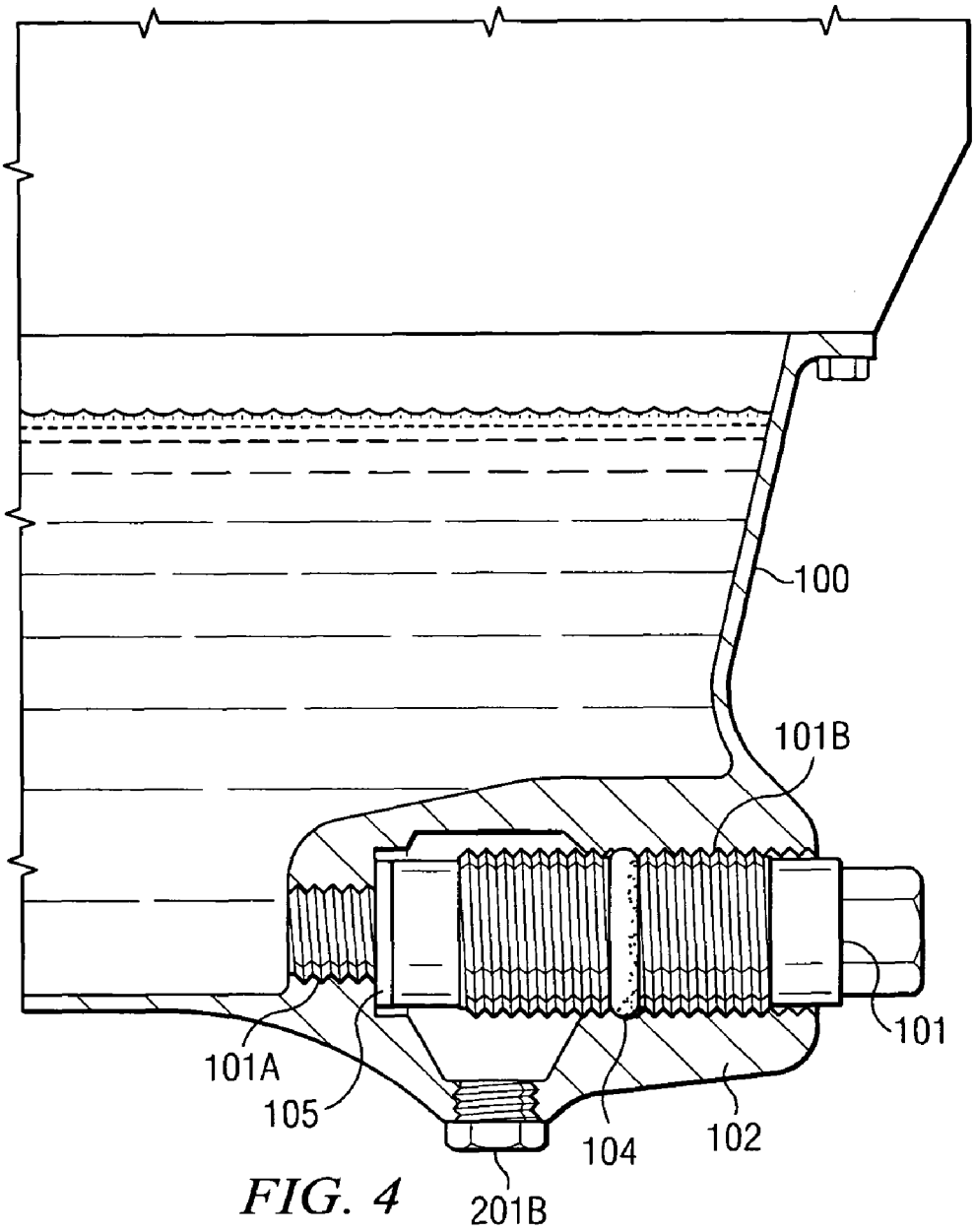
FIG. 4 is a cross sectional view of the drain plug in the drain plug housing of the present invention in the closed position.

FIG. 4 is a magnified view of the further embodiment of the present invention in the closed position. This view provides an additional view of the drain plug 101 which includes first set of threads 101A (having a diameter less than the second set of threads), a oil seal ring washer 105 for sealing oil inside the oil pan, a second set of threads 101B having an optional oil tight washer 104. The multiple thread design of the drain plug is adapted to support the drain plug while it is being screwed into the drain plug housing.

Figure 5A:
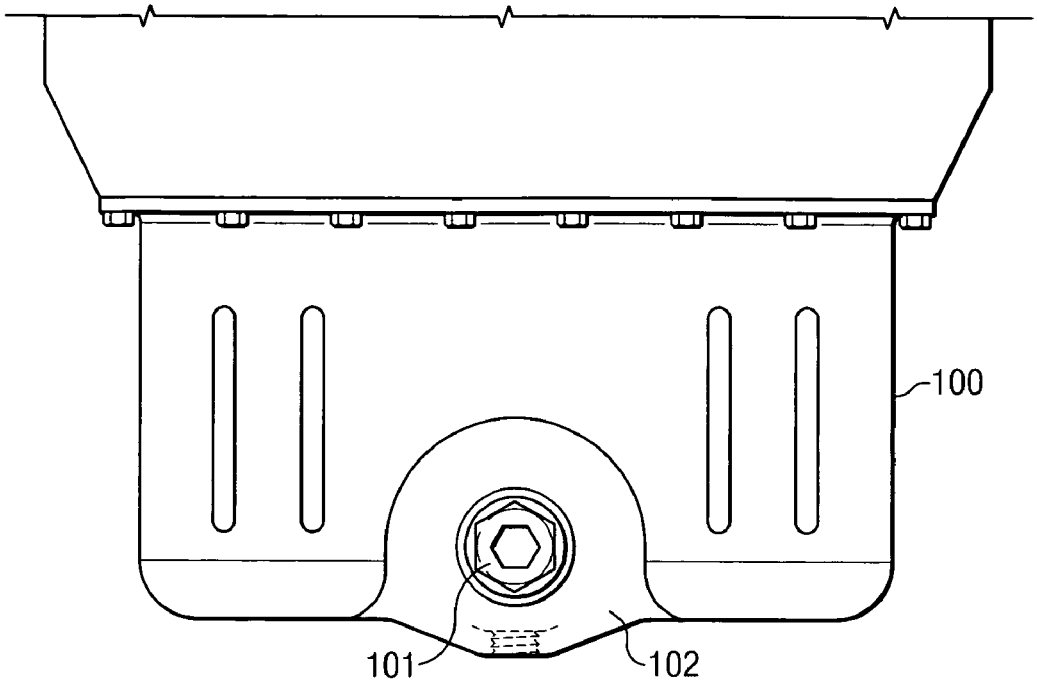
FIG. 5A is a magnified, rear view of an oil pan having the drain plug housing and drain plug of the present invention.

FIG. 5A is a magnified, rear view of an oil pan 100 having the drain plug housing 102 and drain plug 101 of the present invention. As seen therein, the rear view of the drain plug 101 can be adapted to be screwed and unscrewed using a conventional wrench or an Allen wrench. Alternatively, a slot can be provided to receive a screwdriver head, such as, but not limited to, a flat head, Philips head or Torx head screwdriver.

Figure 5B:
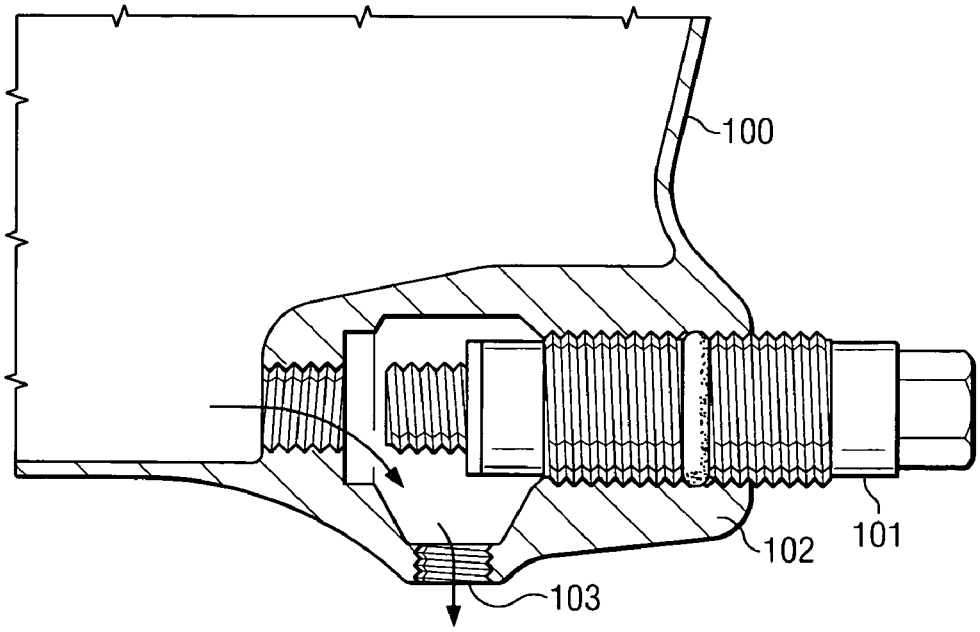
FIG. 5B is a magnified, side view of the drain plug being threaded into the drain plug housing of the present invention.

FIG. 5B is another magnified, side view of the drain plug 101 threaded into the drain plug housing 102 of the present invention being unscrewed therefrom. As seen therein, used oil is then able to escape from the oil drain outlet 103, which, in this view, has been threaded.

Figure 6:
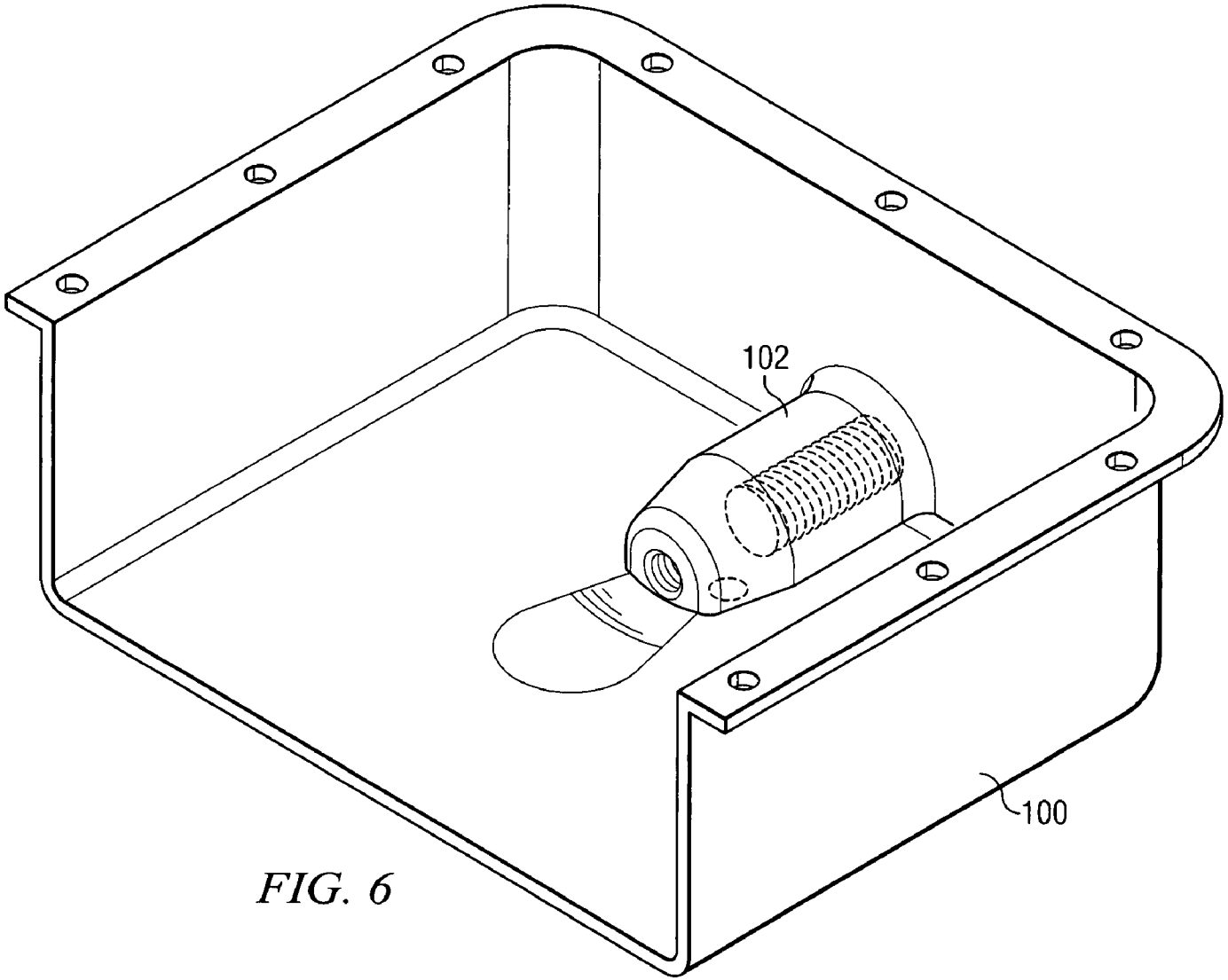
FIG. 6 is a magnified, perspective view of the inside of an oil pan showing the drain plug housing of the present invention.

FIG. 6 is a magnified, perspective view of the inside of an oil pan 100 showing the drain plug housing 102 of the present invention. As seen therein, the drain plug housing 102 is arranged within the oil pan at an incline so that oil collects toward the seal.

Figure 7A:
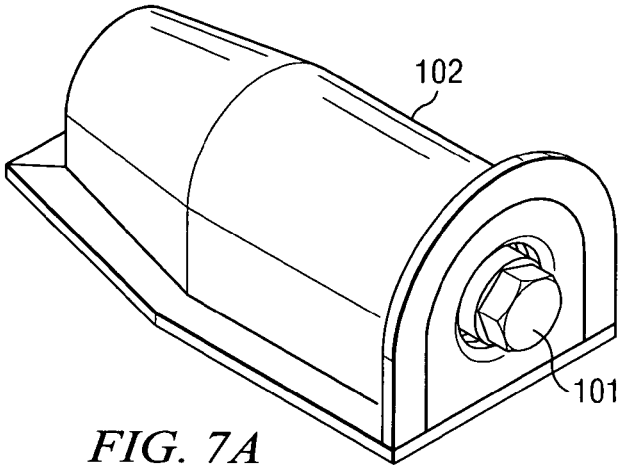
FIGS. 7A-7E are a variety of views of an drain plug housing of the present invention, adapted to be coupled to the inside of an oil pan.
Figure 7B:
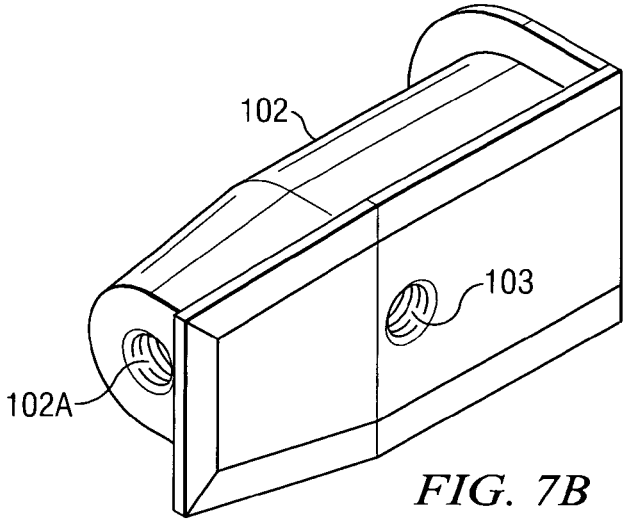
Figure 7C:
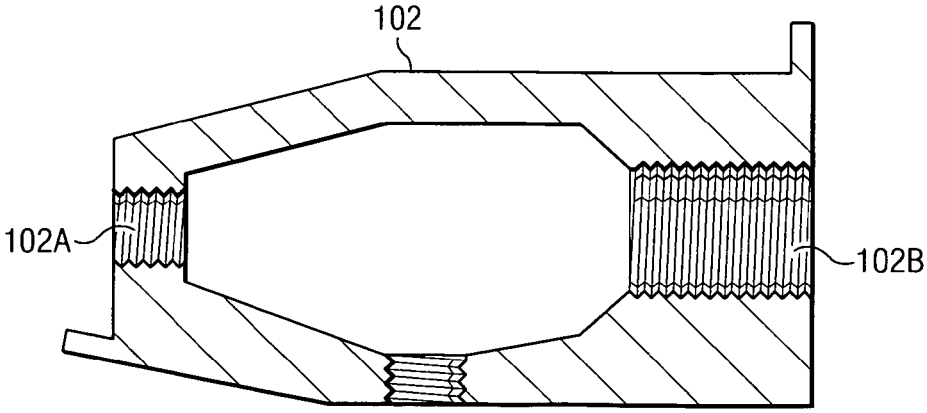
Figure 7D:
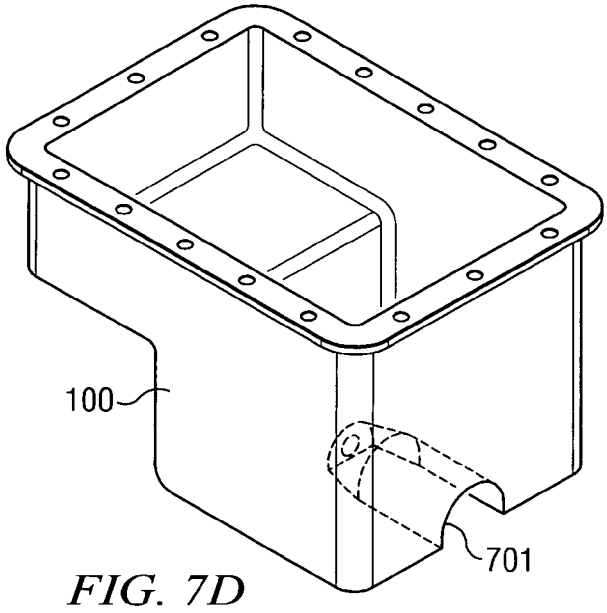
Figure 7E:
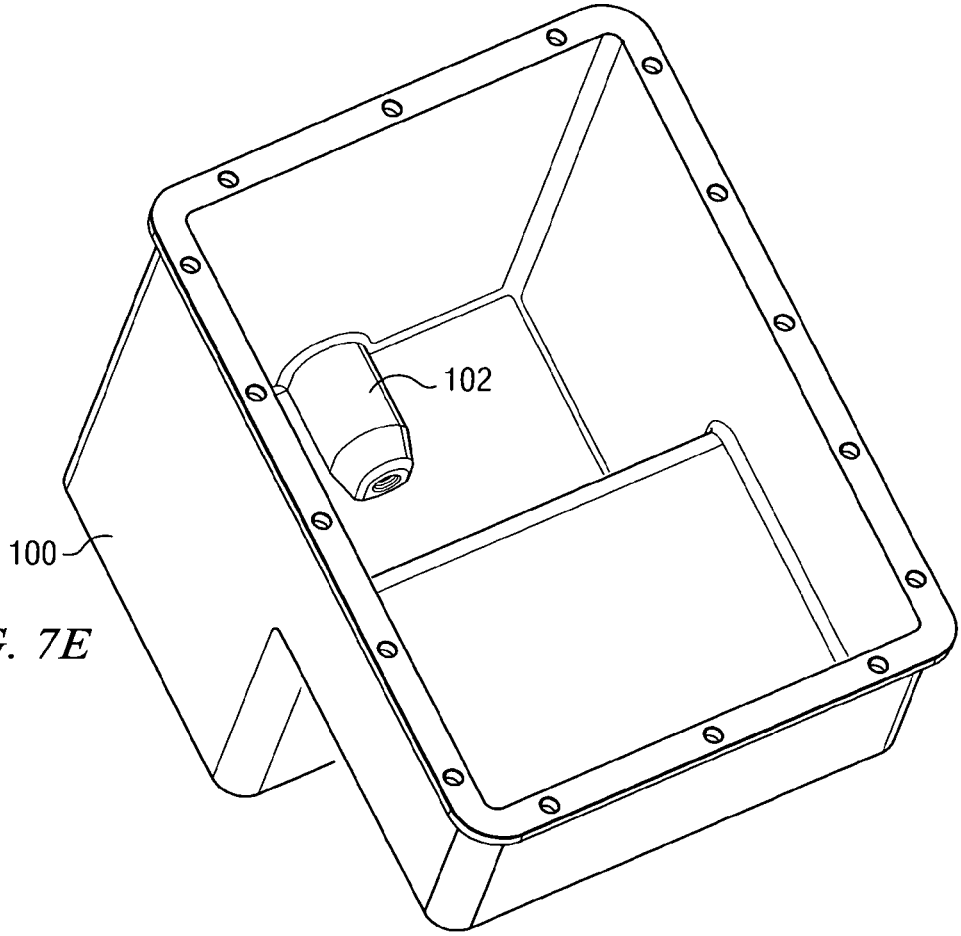

FIGS. 7A-7E are a variety of views of a discrete drain plug housing 102 used in a further configuration of the present invention, adapted to be coupled to the inside of an oil pan. The threaded portions correspond to the descriptions in the Figures above. FIG. 7A includes a view with the engaged drain plug 101. FIG. 7D illustrates an oil pan 100 being formed with an impressed area 701 to receive a drain plug housing 102 as seen in FIG. 7E.

Figure 8:
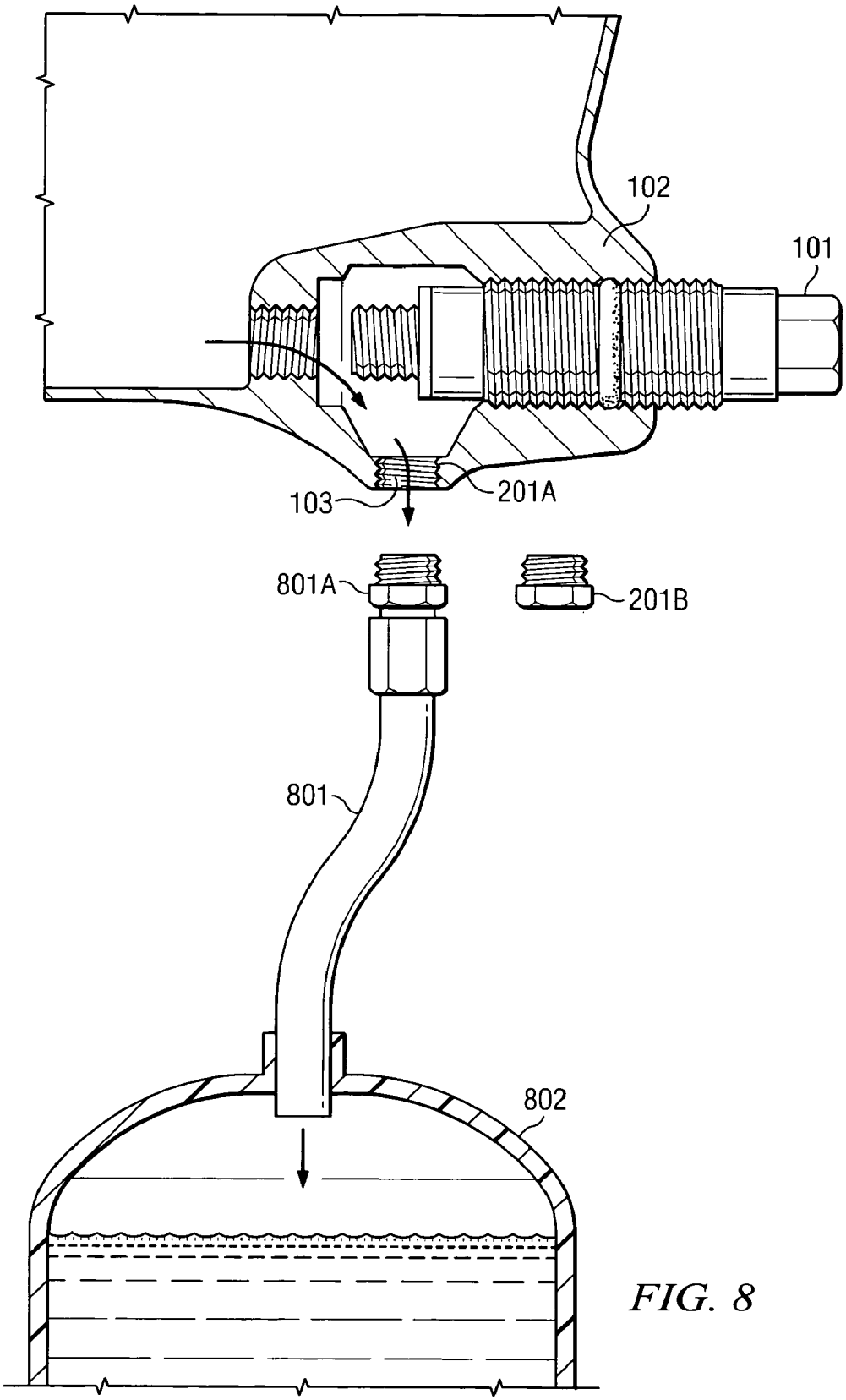
FIG. 8 is a view of a hose adapted to be used with the secondary plug of the present invention so as to enhance the environmental aspects of the present invention.

FIG. 8 is a view of a hose 801 having a threaded coupling 801A adapted to be engaged by third threaded aperture 201A so as to enhance the environmental aspects of the present invention. As seen therein, the drain outlet 103 can have coupled to the third threaded aperture 201A thereof, threaded coupling 801A of hose 801. In this way, oil can be drained into oil container 902. Hose 801 can be a flexible hose made or rubber or metal flex. In this manner, oil removal from oil pan 100 can be accomplished without the typical mess that accompanies the task because one has control over the flow of the oil by using the oil plug 101 as a flow control.

Figure 9:
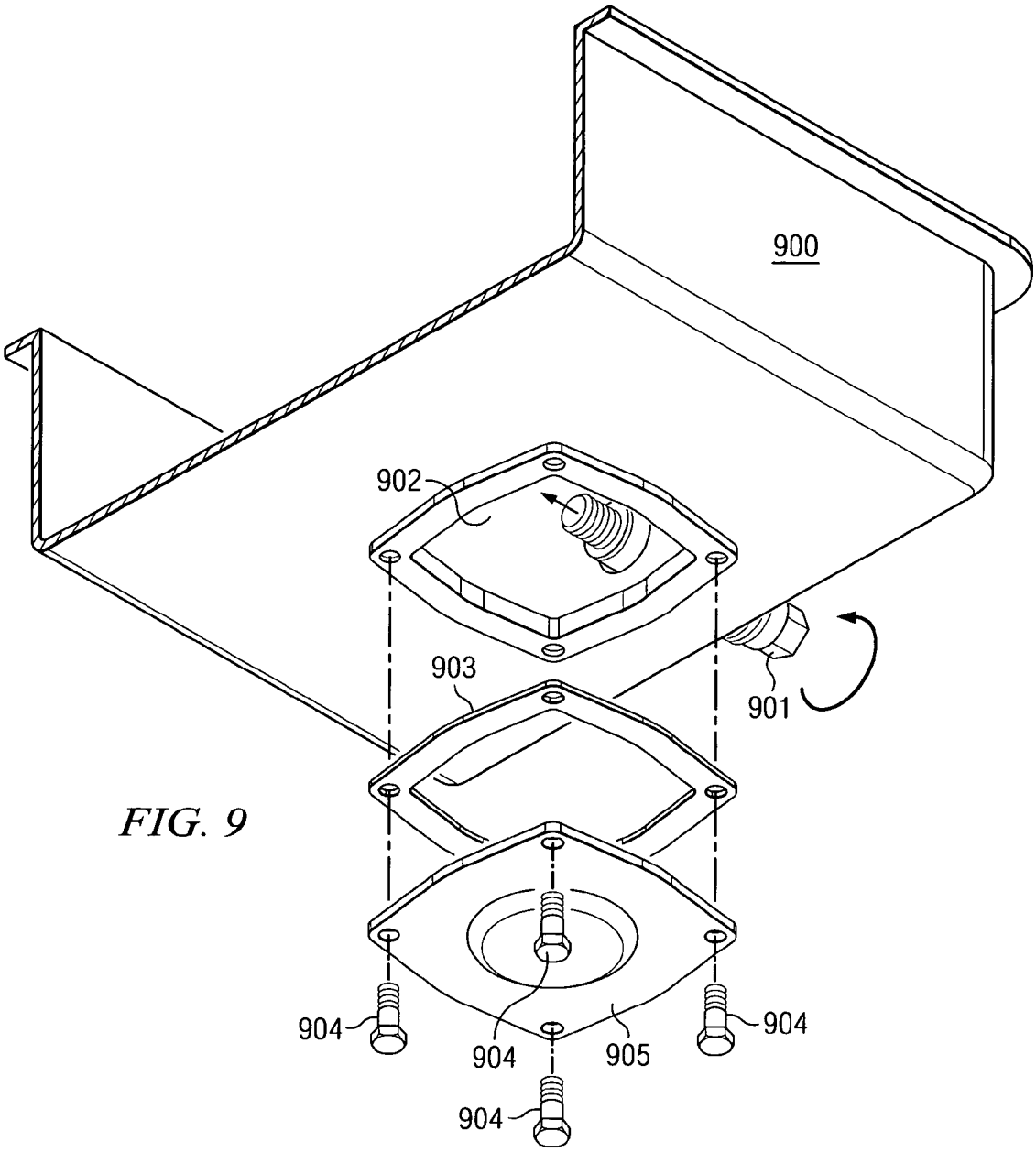
FIG. 9 is a further design aspect of the present invention.

FIG. 9 is a further design aspect of the present invention showing the bottom of an oil pan 900. As seen therein, a plate cover 905 is coupled using plate cover bolts 904 and a gasket 903, to the bottom of the oil pan 900 covering the drain plug housing 902. This option, advantageously, allows access to the drain plug 901 for repair, removal or replacement of the drain plug 901.

Figure 10:
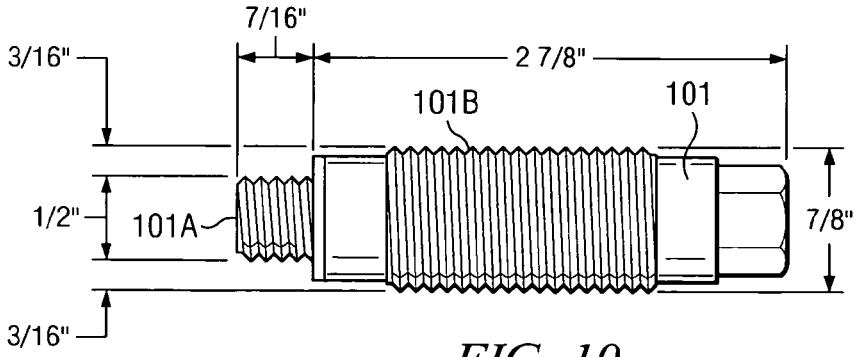
FIG. 10 is a view of an embodiment of the drain plug of the present invention.

FIG. 10 is a side view of a drain plug 101 illustrating exemplary dimensions thereof.

As noted herein, the present invention advantageously facilitates the quick and convenient changing of oil from internal combustion engines of vehicles of all types. It permits the person changing the oil from coming in contact with the oil, which, in many cases, may be very hot. Further, the present invention avoids the disadvantage of lost drain plugs, which often fall out of oil pan and into the hot oil. With the present invention, unlike in conventional oil pans, once oil draining has begun, the oil flow can be stopped or shut off using the present invention. This advantage is not available with conventional oil pans and drain plugs.

As seen in the Figures and the description thereof, the drain plug housing of the present invention is coupled to the inside of an oil pan or is made integral therewith. The bolt type drain plug has an extended length over conventional drain plugs, the present invention preferably being between 2 and 6 inches in length. The first threaded aperture has a set of first set threads that have a relationship to the second set of threads of the second aperture such that, based on the rotation of the drain plug, both the first threaded portion and second threaded portion, move smoothly through their respective aperture without hanging up or locking. The drain plug of the present invention can be made of a variety of material, including carbon steel, carbon alloy steel, steel alloy with chromium and nickel. Further, the materials used in the drain housing of the present invention can be constructed of lightweight materials such as aluminum or carbon based material so as to improve fuel consumption of the vehicle to which it is coupled.

The embodiments shown and described above are only exemplary. Even though numerous characteristics and advantages of the preferred embodiment of the present invention have been set forth in the foregoing description together with details of the invention, the disclosure is illustrative only and changes may be made within the principles of the invention to the full extent indicated by the broad general meaning of the terms used in the attached claims.

I claim:

1. An drainage apparatus for use with an oil pan, comprising:

a substantially cylindrical drain plug of varying diameters having at least a first male threaded portion and a second male threaded portion on an elongate shaft;

a drain plug housing having at least a coaxially aligned first female threaded aperture and second female threaded aperture separated by a hollow cavity, the drain plug housing also having a drain outlet between the first female threaded aperture and second female threaded aperture, the drain outlet being substantially perpendicular to the coaxially aligned first female threaded aperture and second female threaded aperture, the first female threaded aperture serving as a conduit into the cavity of an oil pan; and the first female threaded aperture and second female threaded aperture rotatably engaging with the first male threaded portion and second male threaded portion, respectively, of the drain plug.

2. The drainage apparatus of claim 1, wherein the first male threaded portion of the drain plug has a diameter less than the second male threaded portion of the drain plug.

3. The drainage apparatus of claim 1, further comprising an oil seal ring washer seated on a 90 degree angled face formed at the end of the first male threaded portion of the drain plug, the oil seal ring washer providing a seal between the first female threaded aperture and hollow cavity of the drain plug housing.

4. The drainage apparatus of claim 1, wherein the drain plug housing is adapted to be coupled to the interior of an oil pan.

5. The drainage apparatus of claim 1, wherein the drain plug housing is made integral with the oil pan.

6. The drainage apparatus of claim 1, in combination with an oil pan.

7. The drainage apparatus of claim 6, wherein the oil pan has a substantially inclined bottom so that oil collects near the first threaded aperture of the drain plug housing.

8. The drainage apparatus of claim 1, having a means of tightening the drain plug comprising wrench flats around an end of the drain plug.

9. The drainage apparatus of claim 8, further including one from the group consisting of an aperture to receive an Allen wrench and a slot to receive a screwdriver head.

10. The drainage apparatus of claim 1, further comprising an oil seal ring washer threaded on the second male threaded portion to seal the second female threaded aperture.

11. The drainage apparatus of claim 1, the drain outlet further comprising a third threaded aperture; and a secondary oil plug cap received by the third threaded aperture.

12. The drainage apparatus of claim 11, in combination with a hose having a threaded coupling to be received by the third threaded aperture.

13. The drainage apparatus of claim 1, wherein the drain plug housing is fabricated as an oil shed cover.

14. The drainage apparatus of claim 1, further comprising an oil seal ring washer proximate the first male threaded portion of the drain plug, the oil seal ring washer providing a seal between a portion of the drain plug having a diameter greater than the diameter of the first male threaded portion, thus creating a facing portion of the shaft and a face of a drain plug housing.

15. The drainage apparatus of claim 1, having a tightening means consisting of at least one from the group of wrench flats around the distal end of the drain plug, an aperture to receive an Allen wrench and a slot to receive a screwdriver head.

* * * * *